US011621498B2

(12) United States Patent
Chen

(10) Patent No.: US 11,621,498 B2
(45) Date of Patent: Apr. 4, 2023

(54) ANTENNA STRUCTURE AND ELECTRONIC DEVICE USING SAME

(71) Applicant: Chiun Mai Communication Systems, Inc., New Taipei (TW)

(72) Inventor: Yi-Ting Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 51 days.

(21) Appl. No.: 17/313,305

(22) Filed: May 6, 2021

(65) Prior Publication Data

US 2021/0391656 A1 Dec. 16, 2021

(30) Foreign Application Priority Data

Jun. 12, 2020 (CN) ..... 202010537241.5

(51) Int. Cl.
*H01Q 21/06* (2006.01)
*H01Q 1/24* (2006.01)
*H01Q 1/48* (2006.01)

(52) U.S. Cl.
CPC ..... *H01Q 21/064* (2013.01); *H01Q 1/242* (2013.01); *H01Q 1/48* (2013.01)

(58) Field of Classification Search
CPC ..... H01Q 1/242; H01Q 1/243; H01Q 1/44; H01Q 1/48; H01Q 5/30; H01Q 5/328; H01Q 5/335; H01Q 5/378; H01Q 9/42; H01Q 13/106; H01Q 21/064; H01Q 21/28
See application file for complete search history.

(56) References Cited

U.S. PATENT DOCUMENTS

2019/0393586 A1* 12/2019 Ayala Vazquez ..... H01Q 1/48

FOREIGN PATENT DOCUMENTS

CN 106469844 A * 3/2017 ..... H01Q 1/243
CN 107039766 A 8/2017
CN 113067147 A * 7/2021 ..... H01Q 1/243

* cited by examiner

*Primary Examiner* — Hoang V Nguyen
(74) *Attorney, Agent, or Firm* — ScienBiziP, P.C.

(57) ABSTRACT

An antenna structure of reduced size but operating at multiple frequencies, applied to an electronic device, includes a housing, a system ground plane, and a first feed point. The housing has at least one portion made of metal material and defines a first gap and a second gap. The housing between the first gap and the second gap forms a first radiation portion. The system ground plane is positioned in the housing and defines a first slit. The first slit corresponds to the first radiation portion and communicates with the second gap. The first feed point is positioned on the first radiation portion and is electrically connected to a first feed source for feeding current and signal to the first radiation portion.

18 Claims, 14 Drawing Sheets

ANTENNA STRUCTURE AND ELECTRONIC DEVICE USING SAME

FIELD

The subject matter herein generally relates to wireless communications, to an antenna structure, and an electronic device using the antenna structure.

BACKGROUND

Antennas are for receiving and transmitting wireless signals at different frequencies. However, current antenna structures are complicated and occupy a large space in an electronic device, which makes the miniaturization of the electronic device problematic.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
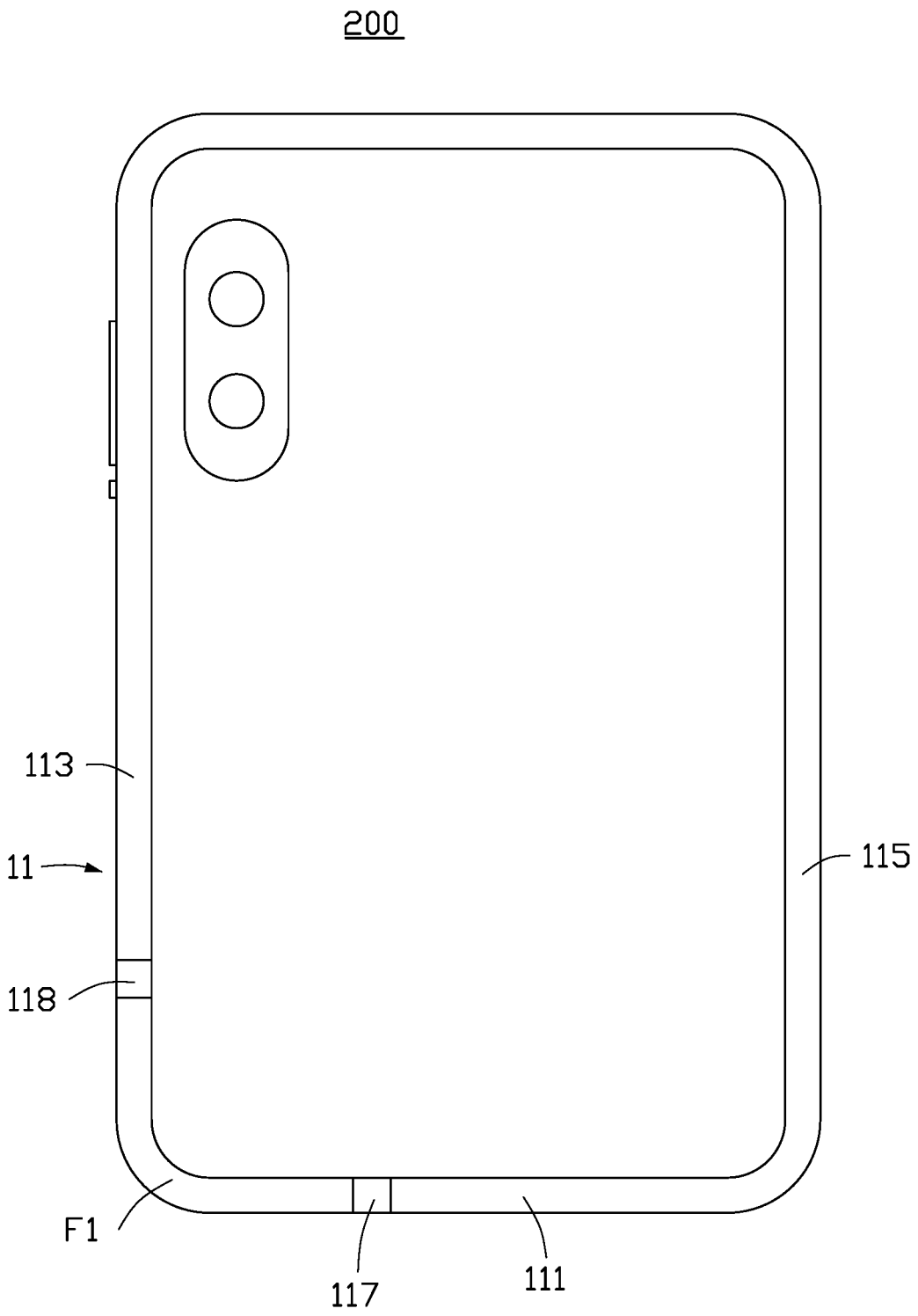
FIG. 1 is a schematic diagram of a first embodiment of an antenna structure, applied in an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and an electronic device using the same.

Figure 2:
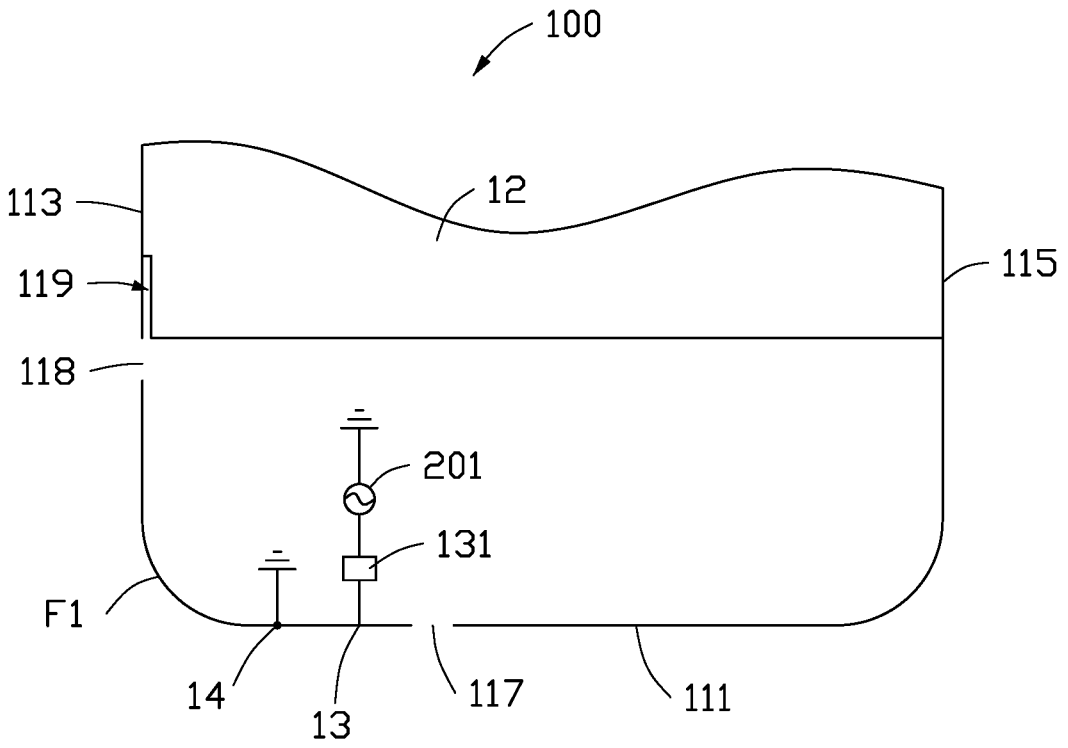
FIG. 2 is a circuit diagram of the antenna structure of FIG. 1.

FIG. 1 and FIG. 2 illustrate a first embodiment of an electronic device 200 using an antenna structure 100. The electronic device 200 can be, for example, a mobile phone or a personal digital assistant. The antenna structure 100 can transmit and receive radio waves.

In this embodiment, the electronic device 200 may use one or more of the following communication technologies: BLUETOOTH communication technology, global positioning system (GPS) communication technology, WI-FI communication Technology, global system for mobile communications (GSM) communication technology, wideband code division multiple access (WCDMA) communication technology, long term evolution (LTE) communication technology, 5G communication technology, SUB-6G communication technology, and other future communication technologies.

In other embodiments, the electronic device 200 may also include one or more of the following components, such as a processor, a circuit board, a display, a memory, a power supply component, an input/output circuit, audio components (such as a microphone and a speaker, etc.), imaging components (for example, a front camera and/or a rear camera), and several sensors (such as a proximity sensor, a distance sensor, an ambient light sensor, an acceleration sensor, a gyroscope, a magnetic sensor, a pressure sensor, and/or a temperature sensor, etc.).

Figure 3:
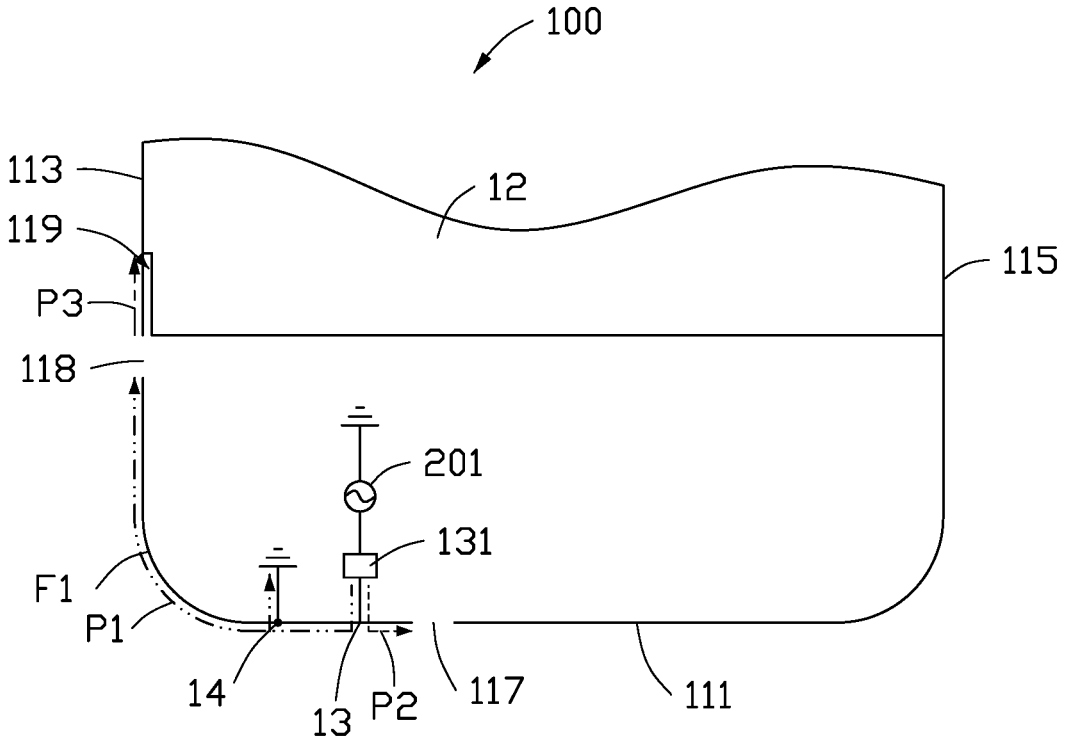
FIG. 3 is a current path distribution graph of the antenna structure of FIG. 2.

As illustrated in FIG. 3, the antenna structure 100 at least includes a housing 11, a system ground plane 12, a first feed point 13, and a ground point 14.

The housing 11 can be a housing of the electronic device 200, for example, can be a side frame of the electronic device 200. The housing 11 is made of metal or other conductive materials. The system ground plane 12 is made be metal or other conductive materials. The system ground plane 12 is positioned in the housing 11 and is configured for grounding the antenna structure 100.

In one embodiment, the housing 11 includes at least a first portion 111, a second portion 113, and a third portion 115. The first portion 111 is a bottom end of the electronic device 200. That is, the first portion 111 is a bottom metallic frame of the electronic device 200. The antenna structure 100 constitutes a lower antenna of the electronic device 200. The second portion 113 and the third portion 115 are positioned opposite to each other, they may be equal in length and longer than the first portion 111. The second portion 113 and the third portion 115 are the metallic side frames of the electronic device 200.

The housing 11 defines at least one gap. In this embodiment, the housing 11 defines two gaps, namely, a first gap 117 and a second gap 118. In detail, the first gap 117 is defined in the first portion 111 adjacent to the second portion 113. The second gap 118 is defined in the second portion 113.

In this embodiment, the first gap 117 and the second gap 118 both penetrate and interrupt the housing 11. The at least one gap divides the housing 11 into at least two radiation portions. In this embodiment, the first gap 117 and the second gap 118 divide the housing 11 into a first radiation portion F1. In this embodiment, the housing 11 between the first gap 117 and the second gap 118 forms the first radiation portion F1. That is, the first radiation portion F1 is positioned at a corner of the electronic device 200, for example, a right lower corner of the electronic device 200, namely, the first radiation portion F1 is formed by a portion of the first portion 111 and a portion of the second portion 113.

In this embodiment, when a width of either the first gap 117 or the second gap 118 is less than 2 millimeters (mm), a radiation efficiency of the antenna structure 100 is affected. Therefore, the widths of the first gap 117 and the second gap 118 are generally not less than 2 mm. Additionally, the greater the width of the first gap 117 and the width of the second gap 118, the better the efficiency of the antenna structure 100. Considering an overall aesthetic appearance of the electronic device 200 in addition to the radiation efficiency of the antenna structure 100, the widths of both the first gap 117 and the second gap 118 can be set to 2 mm.

In this embodiment, the first gap 117 and the second gap 118 are both filled with an insulating material (such as plastic, rubber, glass, wood, ceramic, etc., not being limited to these).

In this embodiment, the first feed point 13 is positioned on the first radiation portion F1 and on the first portion 111. The first feed point 13 may be electrically connected to a matching circuit 131 by means of an elastic sheet, a microstrip line, a strip line, or a coaxial cable, and is electrically connected to a first feed source 201 by the matching circuit 131, to feed current and signals to the first radiation portion F1.

In this embodiment, the matching circuit 131 can be an L-type matching circuit, a T-type matching circuit, a π-type matching circuit, with capacitors, inductors, and a combinations of capacitors and inductors, to adjust an impedance matching of the first radiation portion F1.

In this embodiment, the ground point 14 is positioned on the first radiation portion F1 and on the first portion 111. The ground point 14 is positioned between the second portion 113 and the first feed point 13, and is grounded.

As illustrated in FIG. 2, in this embodiment, one end of the system ground plane 12 adjacent to the first portion 111 and the second gap 118 defines a first slit 119, along a direction parallel to the second portion 113 and close to the first portion 111. The first slit 119 is a straight strip shape communicating with the second gap 118.

FIG. 3 illustrates current paths of the antenna structure 100. When the first feed point 13 supplies a current, the current flows through a portion of the first radiation portion F1 between the first feed point 13 and the second gap 118, towards the second gap 118, and is grounded through the ground point 14 (path P1).

When the first feed point 13 supplies a current, the current also flows through a portion of the first radiation portion F1 between the first feed point 13 and the first gap 117, and towards the first gap 117 (path P2).

In this embodiment, the portion of the first radiation portion F1 between the first feed point 13 and the second gap 118 is a middle frequency/ultra-high frequency/5G NR (N77/N78) radiator, which excites a long term evolution advanced (LTE-A) middle frequency, an ultra-high frequency, and 5G NR N77 and N78 modes. The portion of the first radiation portion F1 between the first feed point 13 and the first gap 117 is a 5G NR N79 radiator, which excites a 5GNR N79 mode.

When the first feed point 13 supplies a current and the current flows through the portion of the first radiation portion F1 between the first feed point 13 and the second gap 118, the current is also coupled to the first slit 119 through the second gap 118 (path P3). Then, the first slit 119 couples and resonates the LTE-A high frequency mode with tunability and good antenna efficiency, so as to generate LTE-A radiation signals of the high frequency band.

In this embodiment, the first feed point 13 and the matching circuit 131 are set at appropriate locations of the main radiator (for example, the first radiation portion F1), and the ground point 14 is set at the part of the first radiation portion F1 between the first feed point 13 and the second portion 113. In this way, LTE-A middle frequency mode, ultra-high frequency mode, and 5G NR mode (including N77/N78/N79 modes) can be achieved by resonance using this antenna architecture.

In this embodiment, frequency offset of 5G NR mode and LTE-A middle frequency mode can be separately controlled by adjusting, for example, fine-tuning the location of the first feed point 13. By adjusting, for example, fine-tuning the location of the ground point 14, a frequency offset of the UHB mode can be independently controlled.

Figure 4:
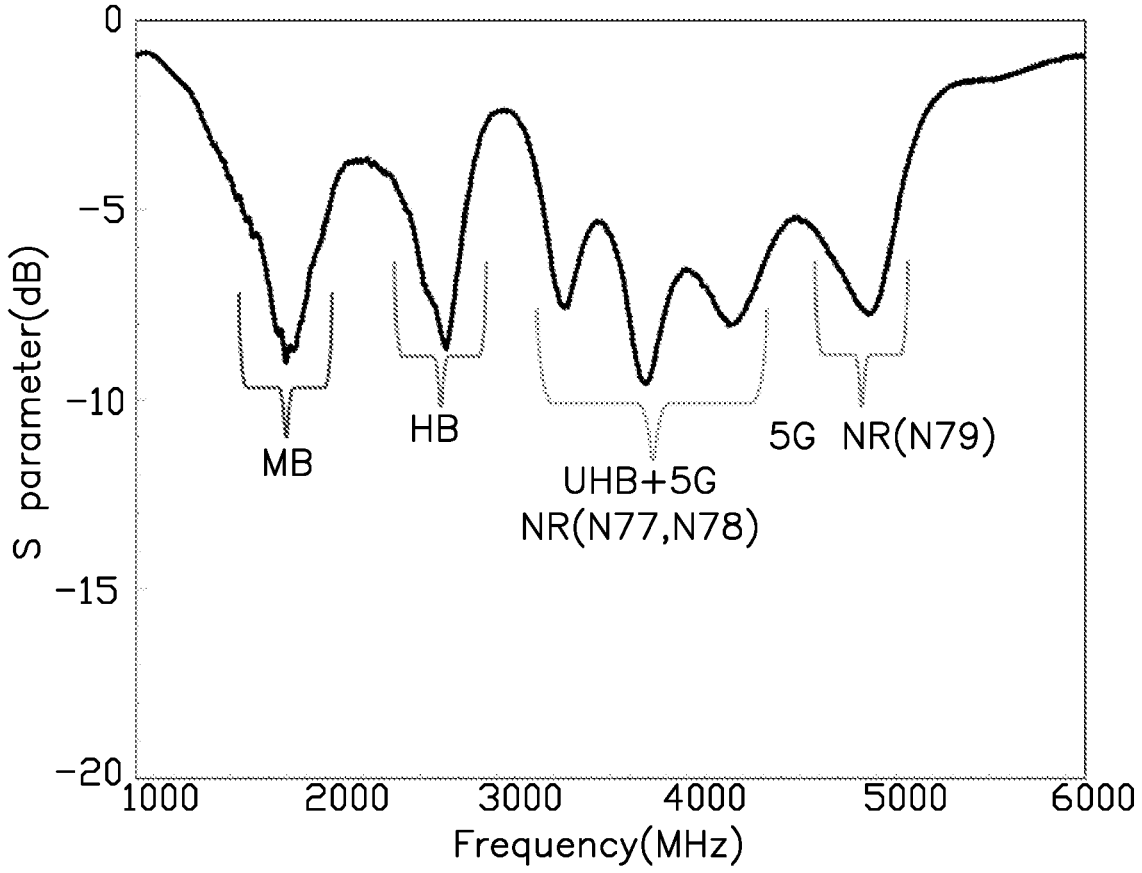
FIG. 4 is a scattering parameter graph of the antenna structure of FIG. 2.
Figure 5:
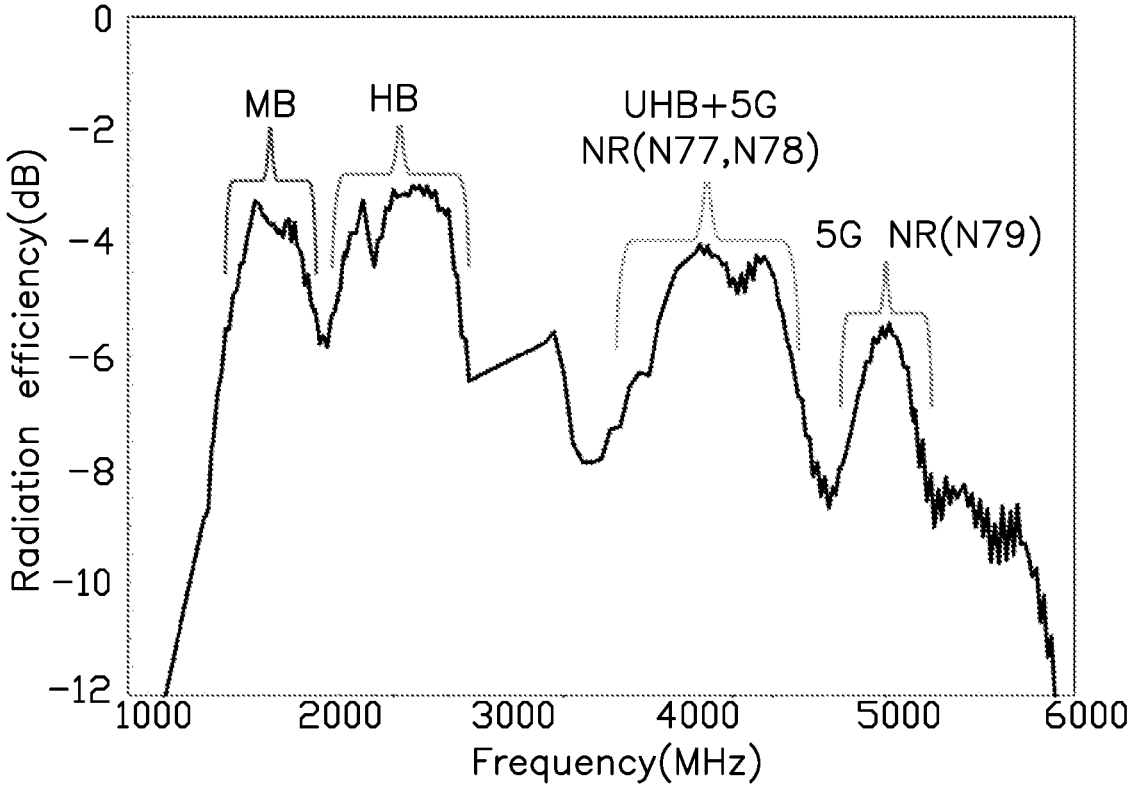
FIG. 5 is a radiation efficiency graph of the antenna structure of FIG. 2.

FIG. 4 is a scattering parameter graph of the antenna structure 100. FIG. 5 is a radiation efficiency graph of the antenna structure 100.

In this embodiment, the antenna structure 100 divides an independent metal radiator (the first radiation portion F1) from the housing 11, by the two gaps, namely the first gap 117 and the second gap 118. Meanwhile, the first slit 119 for coupling is defined on the system ground plane 12 adjacent to the second gap 118. Thus, the antenna structure 100 can generate four independent modes, namely LTE-A middle frequency mode, LTE-A high frequency mode, UHB mode, and 5G NR N77, N78, and N79 modes, without the use of antenna tuner or switch, or other high-frequency tuning elements. The antenna structure 100 achieves a wide range of frequencies only by using common capacitors, inductors, and combinations (such as, the matching circuit 131). The antenna structure 100 can work in a range of middle frequency band (MB) (1710-2170 MHz), a high frequency band (HB) (2300-2690 MHz), ultra-high frequency band (UHB) (3400-3800 MHz), and 5G Sub6 NR N77/N78/N79 (3300-5000 MHz). The antenna structure 100 can cover a frequency band of 1710-5000 MHz, which is the 2G/3G/4G/5G sub 6 communication bands commonly used in the world.

Figure 6:
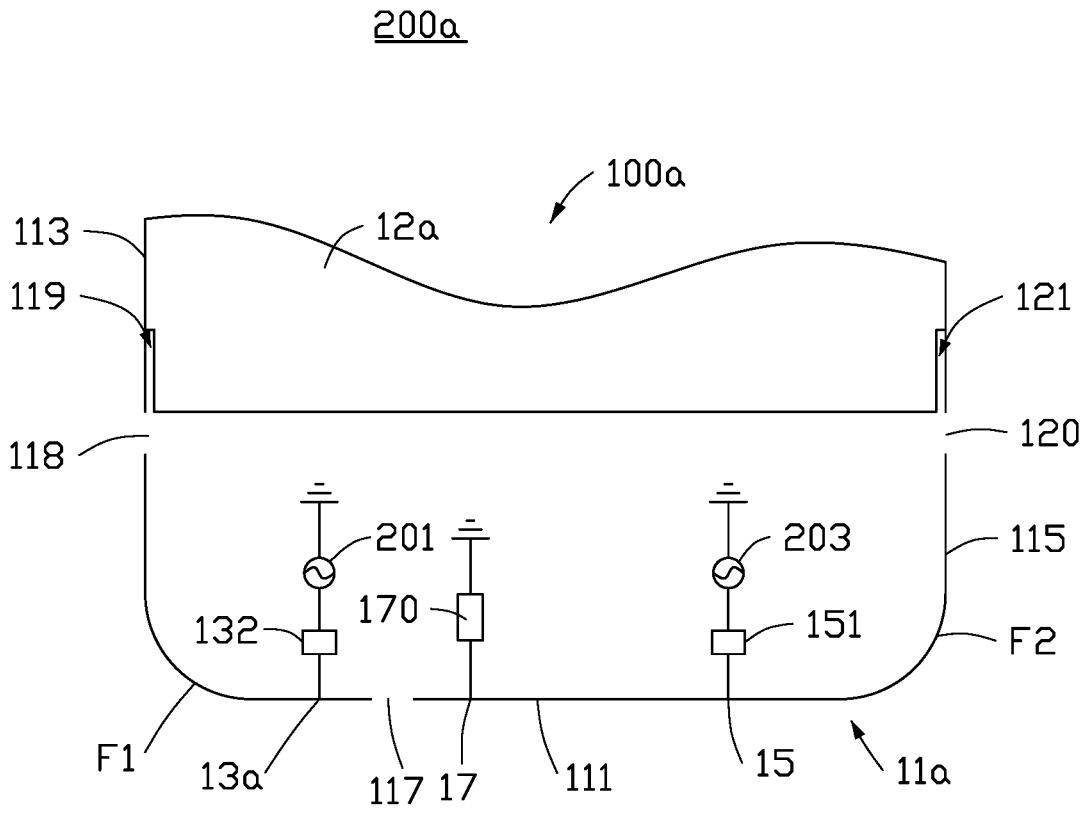
FIG. 6 is a schematic diagram of a second embodiment of an antenna structure.

FIG. 6 illustrates a second embodiment of an electronic device 200*a* using an antenna structure 100*a*. The electronic device 200*a* can be, for example, a mobile phone or a personal digital assistant. The antenna structure 100*a* can transmit and receive radio waves.

The antenna structure 100*a* at least includes a housing 11*a*, a system ground plane 12, and a first feed point 13*a*. The housing 11*a* defines the first gap 117 and the second gap 118, to create the first radiation portion F1 out of the housing 11*a*. The system ground plane 12*a* defines the first slit 119.

In this embodiment, a difference between the antenna structure 100*a* and the antenna structure 100 is that the antenna structure 100*a* does not include the ground point 14, that is, the ground point 14 is omitted. In addition, the first feed point 13*a* of the antenna structure 100*a* is not electrically connected to the first feed source 201 through the matching circuit 131. Instead, the first feed point 13*a* of the antenna structure 100*a* is electrically connected to the first feed source 201 through an antenna tuner 132.

In this embodiment, a further difference between the antenna structure 100*a* and the antenna structure 100 is that the housing 11*a* defines a third gap 120 and the system ground plane 12*a* further defines a second slit 121. In detail, the third gap 120 is defined on the third portion 115. Correspondingly, the housing 11*a* between the first gap 117 and the third gap 120 forms a second radiation portion F2. The second radiation portion F2 is positioned at the corner of the electronic device 200*a*, such as a lower left corner of the electronic device 200*a*. That is, the second radiation portion F2 is formed by part of the first portion 111 and part of the third portion 115. In this embodiment, the third gap 120 is set further away from the first gap 117 relative to the second gap 118. A length of the first radiation portion F1 for electrical purposes is less than that of the second radiation portion F2.

The second slit 121 is defined at one end of the system ground plane 12*a* adjacent to the first portion 111 and the third gap 120, and extends in a direction parallel to the second portion 113 and close to the first portion 111. The second slit 121 is in the shape of a straight strip. The second slit 121 is positioned in parallel with the first slit 119, then the second slit 121 is symmetrically arranged with the first slit 119 on the system ground plane 12*a*. In this embodiment, the second slit 121 communicates with the third gap 120.

In this embodiment, a further difference between the antenna structure 100*a* and the antenna structure 100 is that the antenna structure 100*a* further includes a second feed point 15 and a switching point 17. The second feed point 15 is positioned on the second radiation portion F2 and on the first portion 111. The second feed point 15 may be electrically connected to an antenna tuner 151 by means of an elastic sheet, a microstrip line, a strip line, or a coaxial cable, and is electrically connected to a second feed source 203 by the antenna tuner 151, to feed current and signals to the second radiation portion F2.

Figure 7:
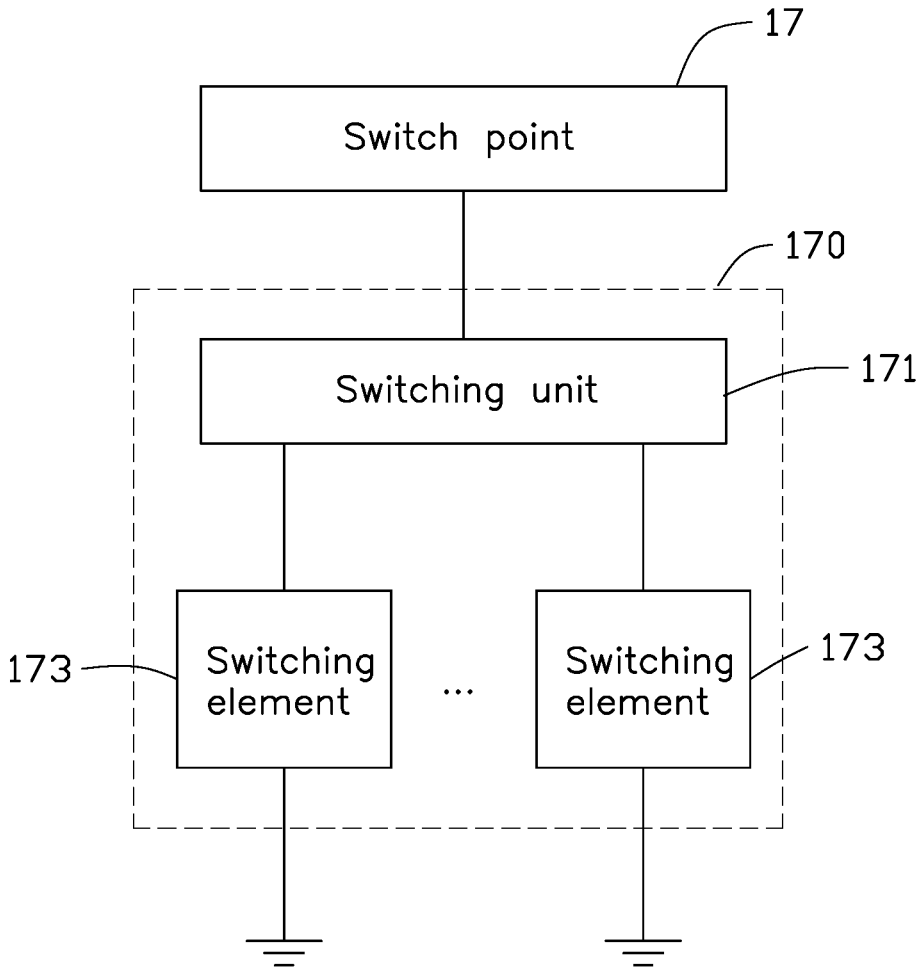
FIG. 7 is a circuit diagram of a switch circuit of the antenna structure of FIG. 6.

In this embodiment, the switching point 17 is grounded through a switch circuit 170. As illustrated in FIG. 7, the switch circuit 170 includes a switching unit 171 and a plurality of switching elements 173. The switching unit 171 may be a single pole single throw switch, a single pole double throw switch, a single pole three throw switch, a single pole four throw switch, a single pole six throw switch, a single pole eight throw switch, or the like. The switching unit 171 is electrically connected to the switching point 17, thereby achieving connection with the second radiation portion F2. The switching elements 173 can be inductors, capacitors, or a combination of them. The switching elements 173 are connected in parallel to each other. One end of each switching element 173 is electrically connected to the switching unit 171. The other end of each switching element 173 is grounded. The switching unit 171 can switch between different switching elements 173 to achieve connection with the second radiation portion F2, thereby the radiation frequencies of the second radiation portion F2 can be adjusted (see detail below).

Figure 8:
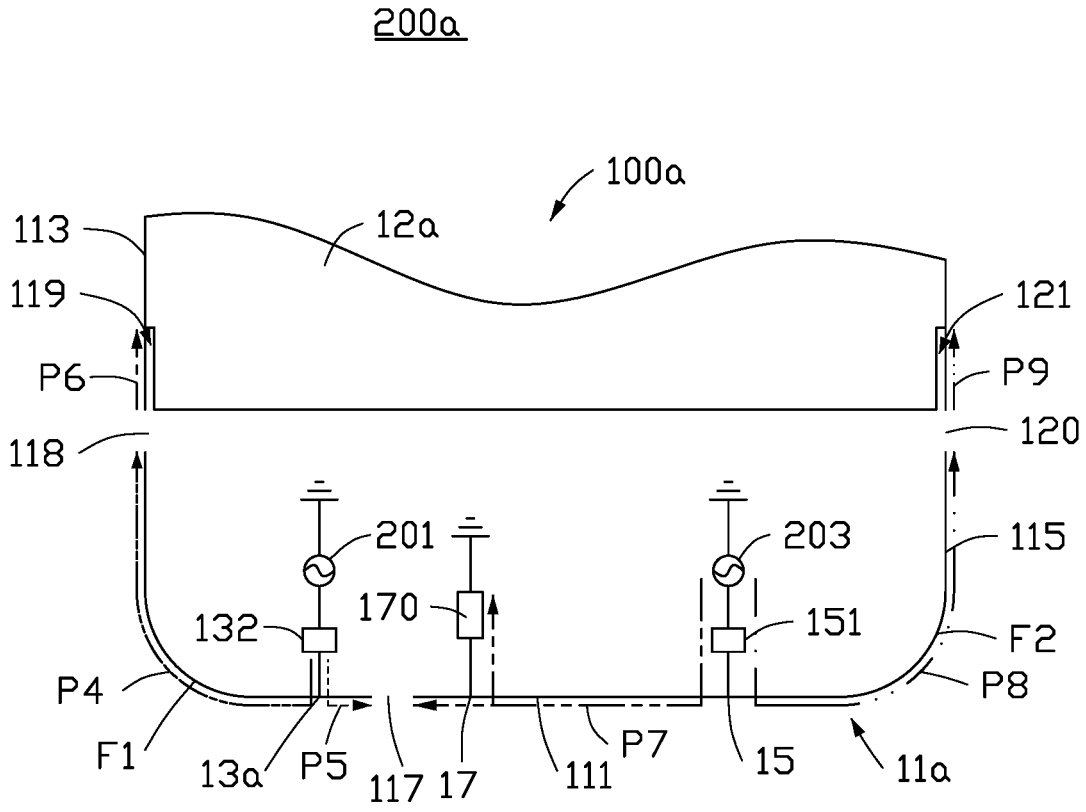
FIG. 8 is a current path distribution graph of the antenna structure of FIG. 6.

In this embodiment, a further difference between the antenna structure 100*a* and the antenna structure 100 is further that a working principle and specific working frequency bands of the first radiation portion F1 of the antenna structure 100*a* are different from those of the first radiation portion F1 of the antenna structure 100. Specifically, as illustrated in FIG. 8, in this embodiment, when the current is fed from the first feed point 13*a*, the current will flow through the portion of the first radiation portion F1 between the first feed point 13*a* and the second gap 118, and flow to the second gap 118 (path P4).

When the current is fed from the first feed point 13*a*, the current will also flow through the portion of the first radiation portion F1 between the first feed point 13*a* and the first gap 117, and flow to the first gap 117 (path P5).

In this embodiment, the portion of the first radiation portion F1 between the first feed point 13*a* and the second gap 118 is a middle frequency/high frequency/ultra-high frequency/5G NR radiator, which is used to excite LTE-A middle frequency, high frequency, ultra-high frequency, 5G NR N77, N78, N79 modes. The portion of the first radiation portion F1 between the first feed point 13 and the first gap 117 is a middle and high frequency radiator, which is used to excite an LTE-A middle and high frequency mode.

When the first feed point 13*a* supplies a current and the current flows through the portion of the first radiation portion F1 between the first feed point 13*a* and the second gap 118, the current is also coupled to the first slit 119 through the second gap 118 (path P6). Then, the first slit 119 can couple and resonate the LTE-A high frequency mode with good antenna efficiency, so as to increase the middle and high frequency bandwidths of the first radiation portion F1.

As illustrated in FIG. 8, in this embodiment, when the second feed point 15 supplies a current, the current flows through the portion of the second radiation portion F2 between the second feed point 15 and the first gap 117, and towards the first gap 117 (path P7).

When the second feed point 15 supplies a current, the current also flows through the portion of the second radiation portion F2 between the second feed point 15 and the third gap 120, and towards the third gap 120 (path P8).

In this embodiment, the portion of the second radiation portion F2 between the second feed point 15 and the first gap 117 is a low frequency radiator, which is used to excite a low frequency mode. The portion of the second radiation portion F2 between the second feed point 15 and the third gap 120 is a middle frequency/high frequency/ultra-high frequency/5G NR radiator, which is used to excite LTE-A middle and high frequencies, an ultra-high frequency, 5G NR N77, N78, N79 modes.

When the second feed point 15 supplies a current and the current flows through the portion of the second radiation portion F2 between the second feed point 15 and the gap 120, the current is also coupled to the second slit 121 through the third gap 120 (path P9). Then, the second slit 121 couples and resonates for an additional working mode with tunability and good antenna efficiency, so as to increase the middle and high frequency bandwidths of the second radiation portion F2.

In this embodiment, the first feed point 13*a* and the antenna tuner 132 are set at appropriate locations of the main radiator (for example, the first radiation portion F1), and the first slit 119 is defined at the system ground plane 12*a*. In this way, LTE-A middle frequency mode, ultra-high frequency band (UHB) mode, and 5G NR mode (including N77/N78/N79 modes) can be achieved by resonance in this antenna architecture, that is, covering frequency band of 1448-5000 MHz.

Additionally, the second feed point 15 and the antenna tuner 151 are set at appropriate locations of the other radiator (for example, the second radiation portion F2), and the second slit 121 is defined at the system ground plane 12*a*. In this way, LTE-A middle frequency mode, UHB mode, and 5G NR mode (including N77/N78/N79 modes) can be achieved by resonance using this antenna architecture, that is, covering a frequency band of 1710-5000 MHz.

Furthermore, by setting the switch circuit 170, the frequency of the low frequency band of the second radiation portion F2 can be adjusted, so that the low frequency band of the second radiation portion F2 covers 700-960 MHz, namely 703-804 MHz, 791-862 MHz, 824-894 MHz, and 880-960 MHz (namely frequency bands of B28/B20/B5/B8).

Figure 9:
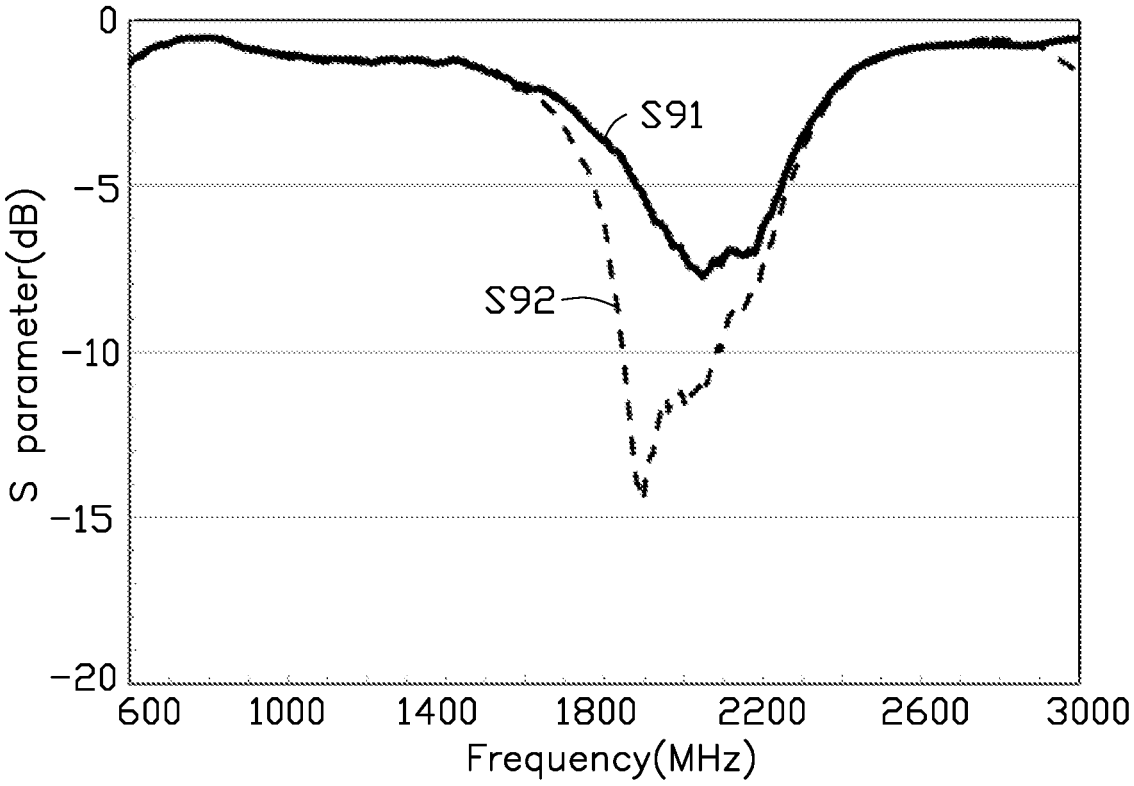
FIG. 9 is a scattering parameter graph of the antenna structure of FIG. 6, showing performance with a first slit defined and performance without.

FIG. 9 is a graph of scattering parameters (S parameters) of the antenna structure 100*a*, showing a comparison when the first slit 119 is defined versus not defined. A curve S91 is an S11 value of the antenna structure 100*a*, when the first slit 119 is not defined. A curve S92 is an S11 value of the antenna structure 100*a*, when the first slit 119 is defined.

Figure 10:
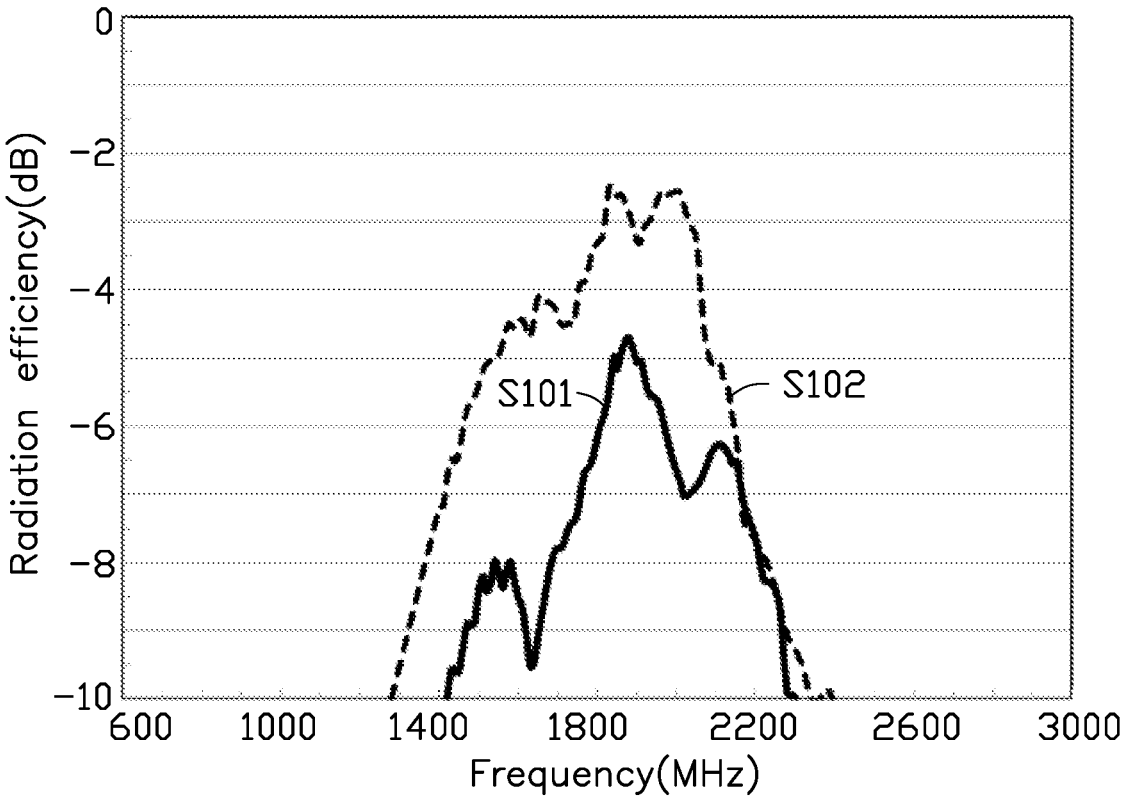
FIG. 10 is a radiation efficiency graph of the antenna structure of FIG. 6, showing performance with the first slit defined and performance without.

FIG. 10 is a graph of radiation efficiency of the antenna structure 100*a*, showing a comparison when the first slit 119 is defined versus not defined. A curve S101 is a radiation efficiency of the antenna structure 100*a*, when the first slit 119 is not defined. A curve S102 is a radiation efficiency of the antenna structure 100*a*, when the first slit 119 is defined.

Figure 11:
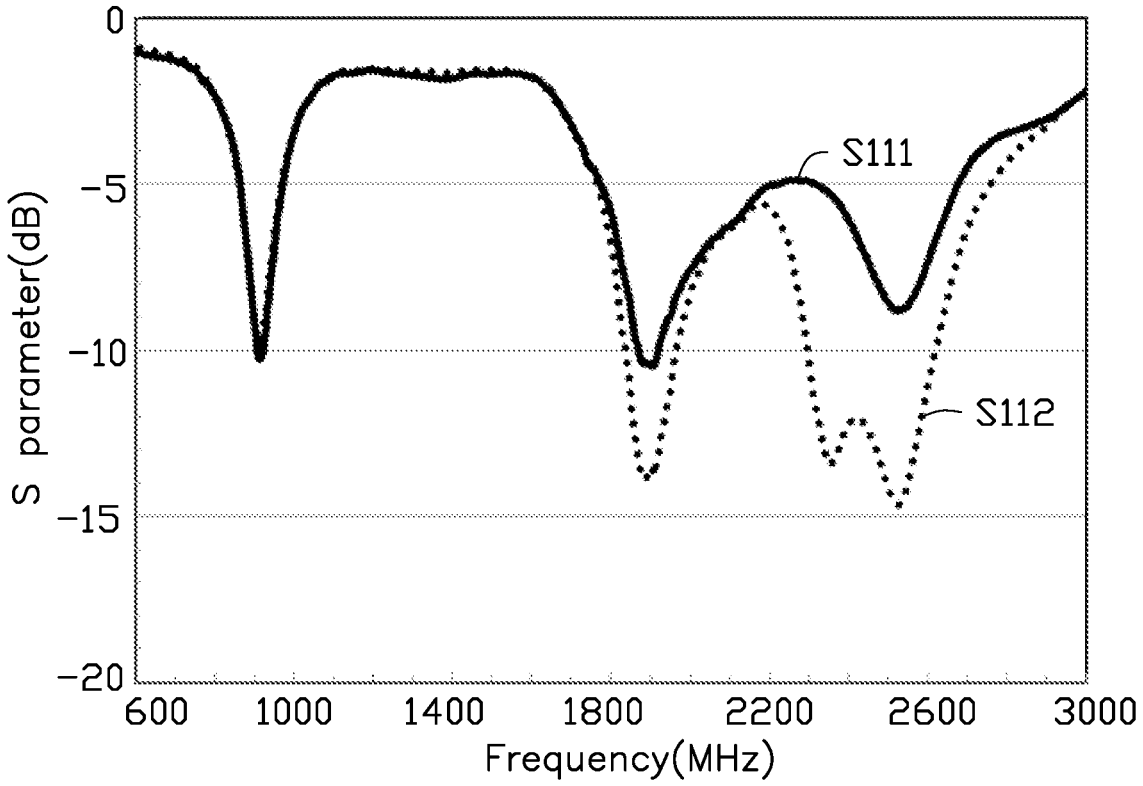
FIG. 11 is a scattering parameter graph of the antenna structure of FIG. 6, showing performance with a second slit defined and performance without.

FIG. 11 is a graph of scattering parameters (S parameters) of the antenna structure 100*a*, showing a comparison when the second slit 121 is defined versus not defined. A curve S111 is an S11 value of the antenna structure 100*a*, when the second slit 121 is not defined. A curve S112 is an S11 value of the antenna structure 100*a*, when the second slit 121 is defined.

Figure 12:
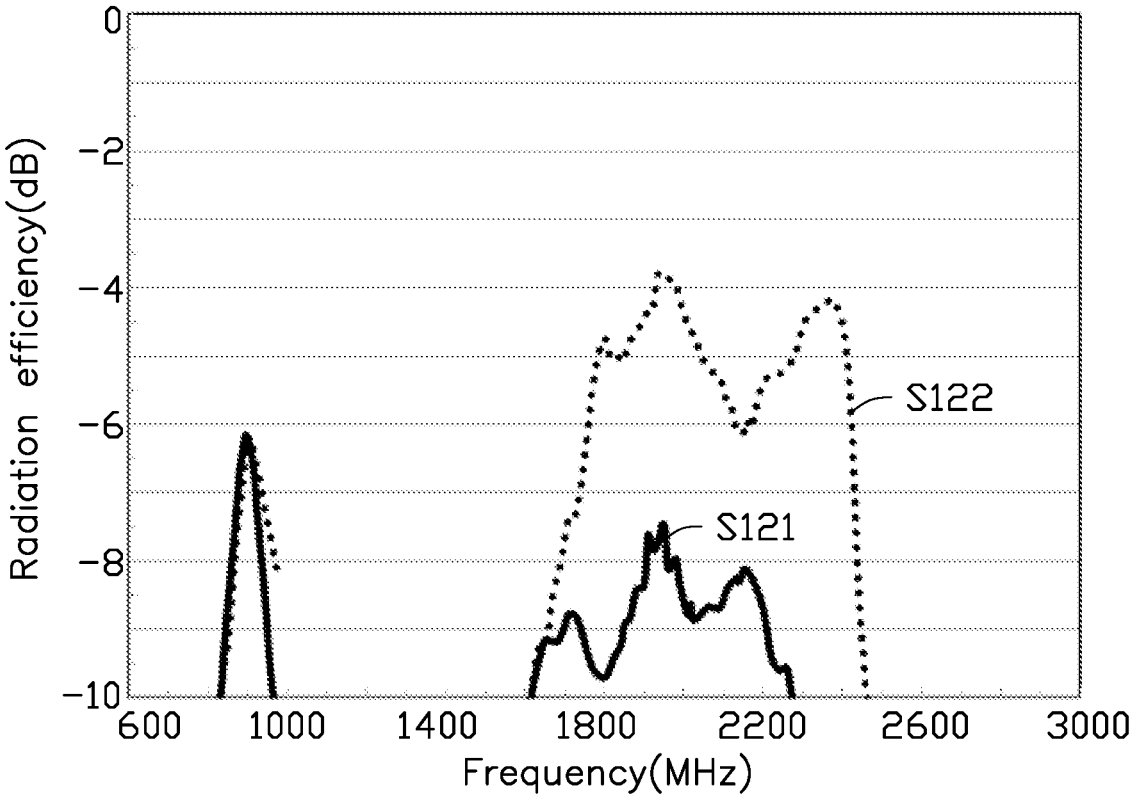
FIG. 12 is a radiation efficiency graph of the antenna structure of FIG. 6, showing performance with the second slit defined and performance without.

FIG. 12 is a graph of radiation efficiency of the antenna structure 100*a*, showing a comparison when the second slit 121 is defined versus not defined. A curve S121 is a radiation efficiency of the antenna structure 100*a*, when the second slit 121 is not defined. A curve S122 is a radiation efficiency of the antenna structure 100*a*, when the second slit 121 is defined.

Figure 13:
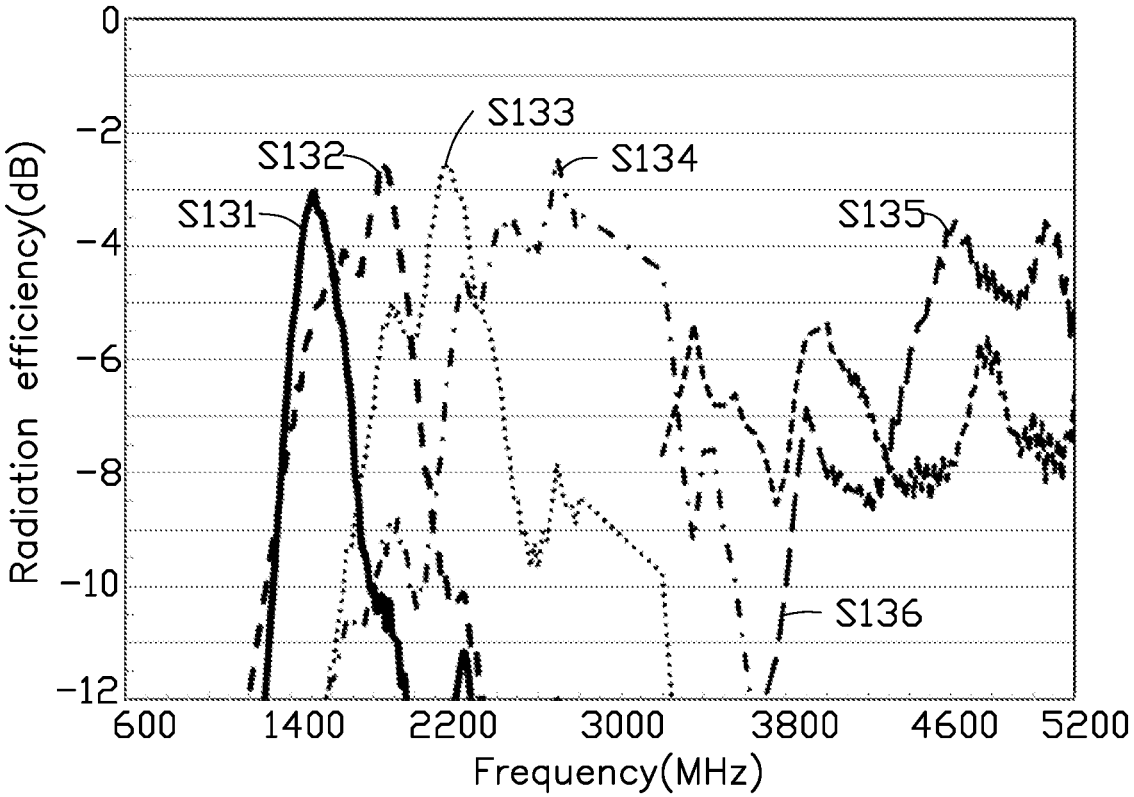
FIG. 13 is a radiation efficiency graph of a first radiation portion of the antenna structure of FIG. 6 showing performance with the first slit defined.

FIG. 13 is a graph of radiation efficiency of the first radiation portion F1 of the antenna structure 100*a*, when the first slit 119 is defined. A curve S131 is a radiation efficiency when the first radiation portion F1 works at an ultra-middle frequency band. A curve S132 is a radiation efficiency when the first radiation portion F1 works at a middle frequency band. A curve S133 is a radiation efficiency when the first radiation portion F1 works at a frequency band of B1 Rx. A curve S134 is a radiation efficiency when the first radiation portion F1 works at a high frequency band. A curve S135 is a radiation efficiency when the first radiation portion F1 works at frequency bands of ultra-high frequency, 5G NR N77, N78. A curve S136 is a radiation efficiency when the first radiation portion F1 works at a frequency band of 5G NR N79.

Figure 14:
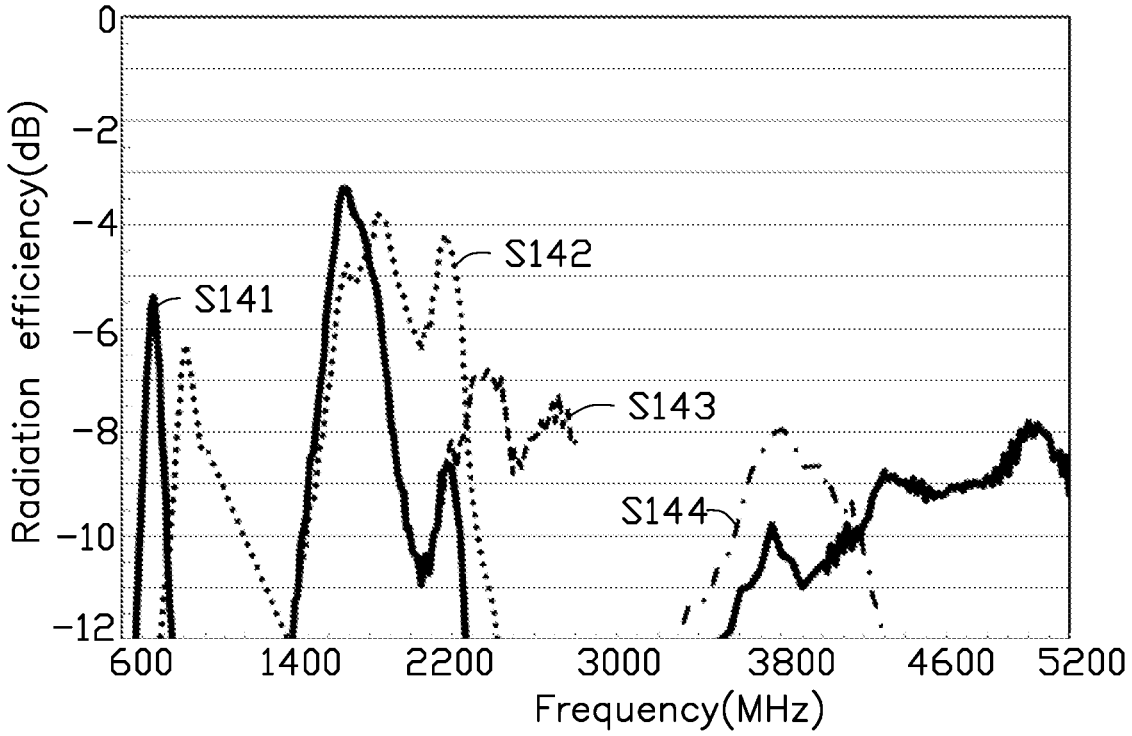
FIG. 14 is a radiation efficiency graph of a first radiation portion of the antenna structure of FIG. 6 showing performance with the second slit defined.

FIG. 14 is a graph of radiation efficiency of the second radiation portion F2 of the antenna structure 100*a*, when the second slit 121 is defined. A curve S141 is a radiation efficiency when the second radiation portion F2 works at frequency bands of LTE-A LB 700, B3 Tx, and 5G NR N79. A curve S142 is a radiation efficiency when the second radiation portion F2 works at frequency bands of LTE-A LB 900 and a middle frequency. A curve S143 is a radiation efficiency when the second radiation portion F2 works at a high frequency band. A curve S144 is a radiation efficiency when the second radiation portion F2 works at frequency bands of ultra-high frequency, 5G NR N77, N78. As shown in FIG. 9 to FIG. 14, the antenna structure 100*a* improves the low frequency bandwidth and has better antenna efficiency by setting the switch circuit 170 to switch the low frequency modes of the antenna structure 100*a*. The low frequency abilities of the antenna structure 100*a* cover frequency bands of B28/B20/B5/B8. Furthermore, by setting double slits, i.e., the first slit 119 and the second slit 121, energy can be coupled to resonate in additional modes, increasing the bandwidth of middle and high frequencies. Compared with the structure not having the first slit 119 and the second slit 121, by setting the first slit 119 and the second slit 121, the antenna structure 100*a* of this disclosure makes the resonance mode adjustable and has good antenna efficiency, for example, antenna efficiency in resonant mode is improved by 2-6 dB.

In this embodiment, by setting the first radiation portion F1, the second radiation portion F2, the first slit 119, and the second slit 121, the antenna structure 100*a* increases the middle and high frequency bandwidths and has a good antenna efficiency. The antenna structure 100*a* also covers the application of global frequency bands and supports frequency bands of 5G Sub6 N77/N78/N79. Specifically, by setting a first feed point 13*a* at an appropriate location of the first radiating portion F1, defining the first slit 119 on the system ground plane 12*a*, and combining with the antenna tuner 132, the operating frequency range of the first radiation portion F1 can cover 1448-5000 MHz. By setting the second feed point 15 at an appropriate location of the second radiation portion F2, defining the second slit 121 on the system ground plane 12*a*, and combining with the antenna tuner 151, the working frequency range of the second radiation portion F2 can cover 1710-5000 MHz.

Furthermore, by adding a switch circuit 170 on a low frequency radiator of the second radiation portion F2 to control the low frequency offset, the low frequency range of the second radiation portion F2 can cover 703-804 MHz, 791-862 MHz, 824-894 MHz, and 880-960 MHz. In other words, the operating frequency range of the antenna structure 100*a* covers low frequency band (703-960 MHz), ultra-middle frequency band (1448-1511 MHz), middle frequency band (1710-2170 MHz), high frequency band (2300-2690 MHz), ultra-high frequency band (3400-3800 MHz), and frequency bands of 5G Sub6 NR N77/N78/N79.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure applied to an electronic device, the antenna structure comprising:

a housing with at least one portion made of metal material, wherein the housing defines a first gap and a second gap, the housing between the first gap and the second gap form a first radiation portion;

a system ground plane positioned in the housing and defining a first slit, the first slit corresponding to the first radiation portion and communicating with the second gap;

a first feed point positioned on the first radiation portion and electrically connected to a first feed source, for feeding current and signal to the first radiation portion; and a ground point, wherein the ground point is positioned on the first radiation portion away from the first gap relative to the first feed point, the ground point is grounded.

2. The antenna structure of claim 1, further comprising a matching circuit, wherein the first feed point is electrically connected to the first feed source through the matching circuit.

3. The antenna structure of claim 1, further comprising a second feed point, wherein the housing further defines a third gap, the third gap is positioned away from the first gap relative to the second gap; wherein the third gap and the second gap are defined at two sides of the first gap, the housing between the first gap and the third gap forms a second radiation portion; wherein the second feed point is positioned on the second radiation portion and is electrically connected to a second feed source for feeding current and signals to the second radiation portion.

4. The antenna structure of claim 3, wherein the system grounding plane defines a second slit corresponding to the second radiation portion, the second slit communicates with the third gap.

5. The antenna structure of claim 4, wherein the first slit and the second slit are symmetrically defined on the system ground plane.

6. The antenna structure of claim 3, further comprising a first antenna tuner, wherein the second feed point is electrically connected to the second feed source through the first antenna tuner.

7. The antenna structure of claim 6, further comprising a second antenna tuner, wherein the first feed point is electrically connected to the first feed source through the second antenna tuner.

8. The antenna structure of claim 3, further comprising a switch point, wherein the switching point is located on the second radiation portion adjacent to the first gap relative to the second feed point, the switching point is grounded through a switch circuit.

9. The antenna structure of claim 8, wherein the switch circuit comprises a switching unit and a plurality of switching elements, the switching unit is electrically connected to the switching point, one end of each switching element is electrically connected to the switching unit, and the other end of each switching element is grounded.

10. An electronic device, comprising:

an antenna structure comprising:

a housing with at least one portion made of metal material, wherein the housing defines a first gap and a second gap, the housing between the first gap and the second gap form a first radiation portion;

a system ground plane positioned in the housing and defining a first slit, the first slit corresponding to the first radiation portion and communicating with the second gap;

a first feed point positioned on the first radiation portion and electrically connected to a first feed source, for feeding current and signal to the first radiation portion; and a ground point, wherein the ground point is positioned on the first radiation portion away from the first gap relative to the first feed point, the ground point is grounded.

11. The electronic device of claim 10, wherein the antenna structure further comprises a matching circuit, the first feed point is electrically connected to the first feed source through the matching circuit.

12. The electronic device of claim 10, wherein the antenna structure further comprises a second feed point, the housing further defines a third gap, the third gap is positioned away from the first gap relative to the second gap; wherein the third gap and the second gap are defined at two sides of the first gap, the housing between the first gap and the third gap forms a second radiation portion; wherein the second feed point is positioned on the second radiation portion and is electrically connected to a second feed source for feeding current and signals to the second radiation portion.

13. The electronic device of claim 12, wherein the system grounding plane defines a second slit corresponding to the second radiation portion, the second slit communicates with the third gap.

14. The electronic device of claim 13, wherein the first slit and the second slit are symmetrically defined on the system ground plane.

15. The electronic device of claim 12, wherein the antenna structure further comprises a first antenna tuner, the second feed point is electrically connected to the second feed source through the first antenna tuner.

16. The electronic device of claim 15, wherein the antenna structure further comprises a second antenna tuner, the first feed point is electrically connected to the first feed source through the second antenna tuner.

17. The electronic device of claim 12, wherein the antenna structure further comprises a switch point, wherein the switching point is located on the second radiation portion adjacent to the first gap relative to the second feed point, the switching point is grounded through a switch circuit.

18. The electronic device of claim 17, wherein the switch circuit comprises a switching unit and a plurality of switching elements, the switching unit is electrically connected to the switching point, one end of each switching element is electrically connected to the switching unit, and the other end of each switching element is grounded.

* * * * *